United States Patent [19]

Fenn

[11] 4,281,632

[45] Aug. 4, 1981

[54] THROTTLE BODY AND MIXING TUBE

[75] Inventor: Gordon W. Fenn, Rochester, Mich.

[73] Assignee: Chrysler Corporation, Highland Park, Mich.

[21] Appl. No.: 13,338

[22] Filed: Feb. 21, 1979

[51] Int. Cl.[3] ..... F02M 29/00

[52] U.S. Cl. ..... 123/590; 261/65

[58] Field of Search ..... 48/180 M, 180 R; 261/65, DIG. 74, DIG. 39; 123/141 R, 52 MB, 590, 591

[56] References Cited

U.S. PATENT DOCUMENTS

| | | | |
|---|---|---|---|
| 1,785,501 | 12/1930 | Secor | 48/180 R |
| 2,589,946 | 3/1952 | Linn | 48/180 R |
| 3,077,391 | 2/1963 | Guffra | 48/180 R |
| 3,393,984 | 7/1968 | Wisman | 48/180 R |
| 3,759,499 | 9/1973 | Lang | 261/65 X |
| 3,785,628 | 1/1974 | Lang | 261/65 |

FOREIGN PATENT DOCUMENTS

| | | | |
|---|---|---|---|
| 213488 | 1/1958 | Australia | 123/141 R |
| 2644444 | 4/1977 | Fed. Rep. of Germany | 123/141 R |

*Primary Examiner*—Harry N. Haroian
*Attorney, Agent, or Firm*—Newtson & Dundas

[57] ABSTRACT

An improvement in preparation of a combustible mixture for an internal combustion engine comprises a throttle body having a butterfly-type throttle blade with a deflector mounted on the downstream face of the blade which acts much like a spoiler to generate turbulence. A mixing tube downstream of the blade generates additional turbulence.

4 Claims, 11 Drawing Figures

THROTTLE BODY AND MIXING TUBE

BACKGROUND AND SUMMARY OF THE INVENTION

This invention pertains to throttle body assemblies for use with internal combustion engines and is particularly concerned with a new and improved throttle body having a blade-mounted deflector and a mixing tube for improved atomization and distribution of fuel, particularly advantageous for use in conjunction with an electronic fuel metering system.

Electronic fuel metering systems offer important advantages and benefits over other types of fuel preparation systems for internal combustion engines. In an electronic fuel metering system the quantity of fuel to the engine is metered electronically in accordance with certain control parameters. An example of such an electronic fuel metering system is shown in U.S. Pat. No. 3,935,851, assigned to the same assignee as the present application. A particularly desirable way to introduce the fuel into the engine induction passage is by utilizing one or more fuel spray bars which spray fuel as distinct jets into the induction passage. An example of such fuel spray bars is shown in U.S. Pat. No. 4,132,204, also assigned to the same assignee as the present application. In this latter patent the throttle body assembly which is used with the disclosed spray bar system has rectangular shaped induction ports with a pair of counter-rotatable throttle blades disposed in each port. Fuel is sprayed centrally of each port toward the opening defined between the juxtaposed edges of the throttle blade pair.

There are certain advantages to throttle bodies which incorporate circular induction ports, as opposed to rectangular or other shaped ports. For one, a circular shaped port is generally easier to machine from a rough casting than is a rectangular shaped port. Also, the circular shape is akin to that used in conventional, commercially available carburetors, and hence allows use of more or less conventional butterfly-type throttle blades. Heretofore however, the use of circular port throttle bodies and butterfly type throttle blades in conjunction with an electronic fuel metering system has been considered impractical for the purpose of achieving compliance with mandated governmental regulations relating to vehicle exhaust emissions and fuel economy.

The present invention provides a solution which is capable of rendering the use of circular port throttle bodies compatible with an electronic fuel metering system toward achieving compliance with mandated regulations. Thus, the invention means that a fuel mangement system can incorporate the benefits of both of electronic fuel metering technology and more or less conventional carburetor manufacturing technology insofar as the latter relates to manufacturing of the circular ports and blades. The invention requires a minimal number of parts, is of economical manufacture and performs well.

According to one aspect of the invention, a deflector mounts on the downstream face of the throttle blade to act much like spoiler in generating turbulence. According to another aspect, a mixing tube downstream of the blade generates additional turbulence. These features, individually and collectively contribute to improved fuel preparation.

The foregoing features, advantages and benefits of the invention, along with additional ones, will be seen in the ensuing description and claims which are to be considered in conjunction with the accompanying drawings. The drawings disclose a preferred embodiment of the present invention according to the best mode presently contemplated in carrying out the invention.

DESCRIPTION OF THE PREFERRED EMBODIMENT

Figure 2:
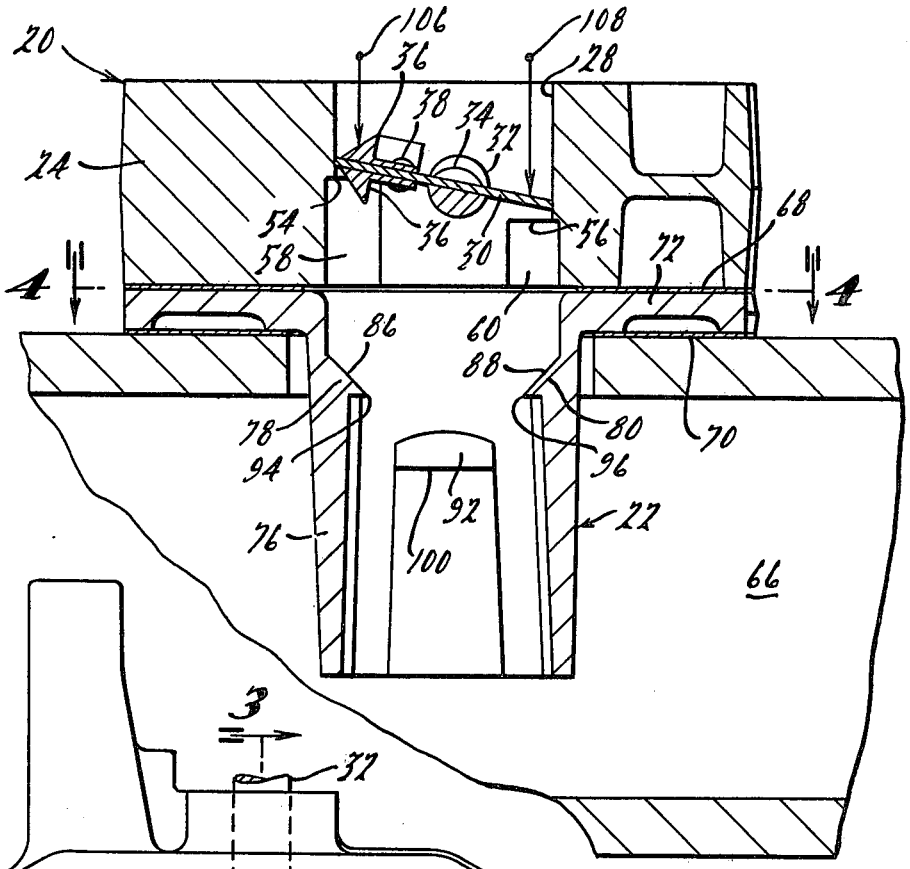
FIG. 2 is a vertical sectional view taken in the direction of arrows 2—2 in FIG. 1.

Looking first to FIGS. 1–5, the reader will see a throttle body assembly 20 in association with a mixer or diffuser, 22 incorporating principles of the present invention. Throttle body assembly 20 comprises a throttle body 24 having a pair of circular induction ports 26, 28. Disposed within each induction port is a generally circular, flat throttle blade, or disc, 30. A shaft 32 journaled on throttle body 24 for rotation about its own axis passes across the throttle body extending through both induction ports. The otherwise circular shaft has localized recesses in the induction ports so that the flat throttle blades may be conveniently and securely attached thereto by means of screws 34. The axis of shaft 32 is offset slightly from the axis of the induction ports (slightly to the right as viewed in FIGS. 1, 2 and 5) so that as viewed in FIGS. 2 and 5 the throttle blades tend to be self-closing in the counterclockwise direction when in use. Although the actuating mechanism for rotating throttle shaft 32 is not shown in the drawings, it will be appreciated that the mechanism is operative to selectively rotate the throttle blades away from the closed position shown in FIGS. 2 and 5 in the clockwise direction over a range of open positions to a wide open throttle position wherein the blades approach a vertical orientation (for example, similar to that shown in FIG. 11). With the blades displaced from the closed position, there are created in each induction port a right hand opening (defined by the right hand, essentially semi-circular, edge of the blade and the right hand half of the port wall) and a left hand opening (defined by the left hand, essentially semi-circular, edge of the blade and the left hand half of the port wall). Thus, it will be appreciated that the structure thus far described may be considered as being generally conventional, with the blades being of the well-known butterfly type.

Figure 5:
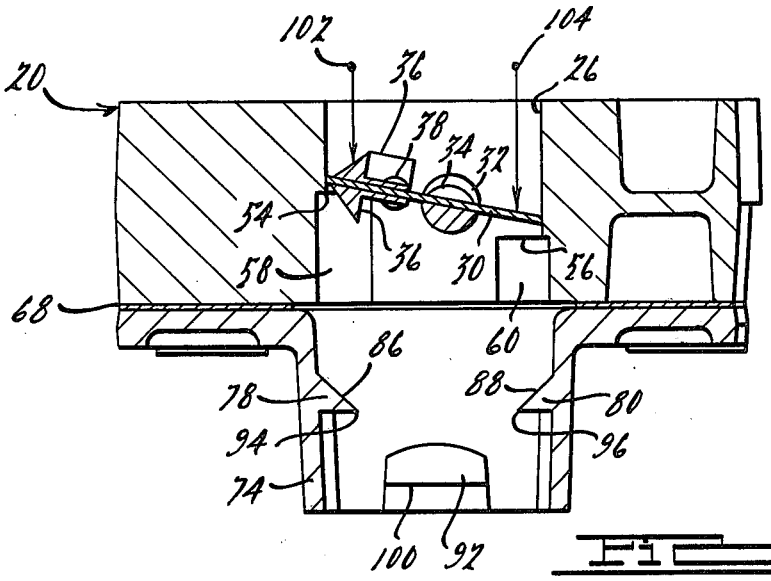
FIG. 5 is a vertical sectional view taken in the direction of arrows 5—5 in FIG. 1.
Figure 6:
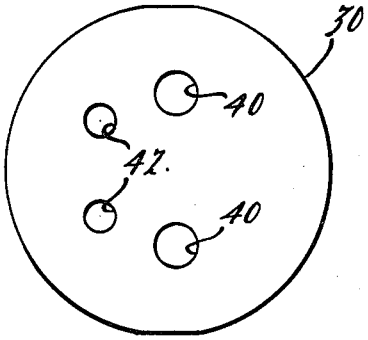
FIG. 6 is a horizontal view of a throttle blade used in the device, and shown by itself.
Figure 8:
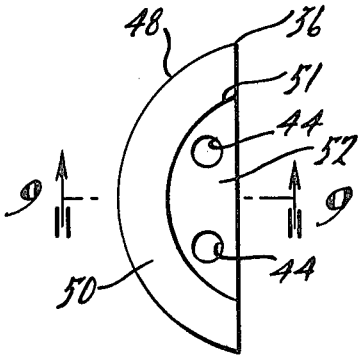
FIG. 8 is a top plan view of a deflector used in the device, and shown by itself.

In accordance with principles of the present invention a deflector 36 is attached to the downstream face of each throttle blade 30 by means of a pair of rivets 38. There is also an identical deflector on the upstream face of each blade in accordance with an invention disclosed and claimed in the application of Kenneth A. Graham entitled "Throttle Body Having a Deflector for the Throttle Blade and Improved Atomization" filed on even date herewith and assigned to the same assignee as this application. Turning for the moment to FIGS. 6 and 8, it can be seen that each throttle blade 30 has a pair of holes 40 via which screws 34 pass to attach the blade to the throttle shaft and a pair of holes 42 via which the rivets secure deflectors 36 to the blade. Each deflector 36 includes a pair of holes 44 utilized for attachment thereof to the throttle blade. Each deflector 36 has a flat base surface 46 which is disposed against throttle blade 30. The deflector further includes an arcuate edge segment 48 which extends around a segment of the margin of the throttle blade. A deflection surface 50 inclines from the arcuate edge 48, as viewed in a radical cross-section, with the throttle blade in the position shown in FIGS. 1, 2 and 5, radially inwardly in the upstream direction for the upper deflector and radially inwardly in the downstream direction for the lower deflector. The deflection surface 50 terminates in an arcuate edge 51 opposite edge 48. A thin web of material 52 which forms a portion of the flat base surface 46 contains the two holes 44 used to secure the deflector to the disc. As explained in detail in the referenced application filed of even date, the purpose of the upper deflector 36 is to assist in directing fuel toward the juxtaposed left hand half of each induction port wall (as viewed in FIGS. 1, 2 and 5) over at least a portion of the operative range of displacement of the throttle blades from the closed position shown in these Figs. so that fuel is directed through the left hand opening in each port. Because each throttle blade, per se, inclines toward the right hand portion of its induction port wall, fuel introduced upstream of the blades will tend to be inherently directed toward the right hand half of the port walls and through the right hand openings. Absent the upper deflector 36 there would tend to be a greater disparity in fuel distribution between the right hand and left hand openings. Fuel from orifices 102 (to be hereinafter described) without the upper deflectors 36 would flow down the inclined blades 30 from left to right causing excessive fuel to pass on the right side of the blades. The upper deflectors 36 lessen this disparity so that better atomization and distribution of fuel occur. Sharp arcuate edges 54 and 56 respectively are provided on the wall of each induction port by undercuts 58 and 60, respectively. Edges 54, 56 promote shearing of fuel from the walls by the high velocity induction airstream to improve fuel atomization. A passage 62 which intercepts each induction passage 26, 28 at the edge of the corresponding undercut 60 communicates via a port 64 with external equipment, such as the crankcase PCV valve, used in automotive emissions control systems. Similar arrangements such as referenced by the numeral 65 in FIG. 1 can be employed for other systems, such as evaporative emissions control systems.

The purpose of the deflector 36 on the downstream face of each blade is to further improve distribution of fuel in the engine cylinders, particularly at increased throttle openings. In a V-type engine, such as a V-8 engine, the throttle body is usually centrally located on the intake manifold. The manifold may be of the dual plane type having two separate runners, each feeding one bank of cylinders. One of the two ports 26, 28 feeds one runner, and hence half the cylinders, and the other port, the other runner and hence the remaining cylinders. Thus, for each runner, two cylinders are fore and two are aft of the throttle body. Because blade 30 inherently inclines as shown, there is a tendency toward unequal fore and aft distribution of fuel. Blade 30, per se, acts like an air-foil. The deflectors 36 act as spoilers imparting increased turbulence which is beneficial in preparation of the mixture and tending to lessen the disparity in fore-aft distribution. The invention of this application, by mounting the second deflector on the downstream face of the blade, achieves a further improvement over that of the Graham application mentioned above.

The preferred use of throttle body assembly 20 is in conjunction with mixer 22 wherein the two mount together and on an engine intake manifold 66, shown in FIG. 2 only. Preferably there is a gasket 68 between throttle body assembly 20 and mixer 22 and the upper wall of the intake manifold to which the two units 20 and 22 are assembled by any suitable means, such as by attaching bolts (not shown).

Figure 3:
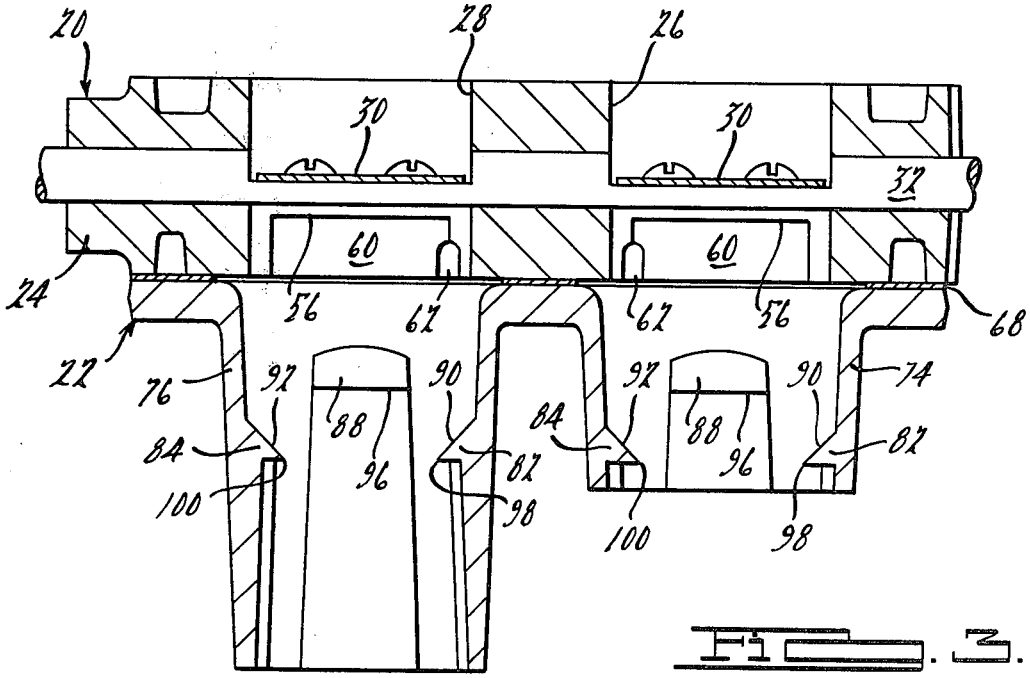
FIG. 3 is a vertical sectional view taken in the direction of arrows 3—3 in FIG. 1.

The disclosed embodiment is intended, as explained, for use with an eight cylinder engine having a dual plane intake manifold. The plane of one runner is above that of the other runner, and hence mixer 22 includes two tubes 74, 76 respectively which have different lengths. The shorter tube 74 which aligns with induction port 26 supplies the upper plane of the manifold while the longer tube 74 aligns with port 28 and supplies the lower plane of the manifold. The two tubes 74, 76 extend into the respective planes of the manifold and the bottom of each tube is spaced above the bottom wall of its manifold plane a predetermined distance, say $\frac{3}{4}$ inch. Additionally, the tubes have further structure on their inner walls which assists in promoting even further fuel turbulence, and resultant improved atomization, after the fuel has passed through the induction ports of the throttle body assembly. Each tube comprises four deflectors 78, 80, 82 and 84 which are uniformly circumferentially arranged as can be seen most clearly in FIG. 4. However, as can be seen in FIGS. 2, 3 and 5, diametrically opposite deflectors are located at different elevations. The deflectors are generally identical and comprise inclined deflection surfaces 86, 88, 90 and 92 respectively, which terminate in sharp edges 94, 96, 98, 100 respectively. Deflectors 78 and 80 are respectively located directly beneath the left hand and right hand edges of each throttle blade with the blades in closed position, and thus are also directly below the shearing edges 54 and 56 of each induction port. Deflectors 82 and 84 are further downstream of deflectors 78 and 80. The latter project radially into their respective ports further than the corresponding edges 54, 56 so that at least some of the fuel which is sheared from edges 54, 56 impinges upon the deflection surfaces 86, 88 to be subsequently sheared from the edges 94, 96. A circumferential component of motion is imparted to the turbulent mixture, and with deflectors 82 and 84 being disposed as they are, some of the fuel sheared from edges 78, 80 impinges on surfaces 90, 92 to be subsequently sheared from the edges 98, 100. Thus, significantly increased turbulence is imparted to the induction charge as it passes through each mixing tube, resulting in more complete combustion, and in turn improvement in fuel economy and reduction in exhaust emissions.

Figure 1:
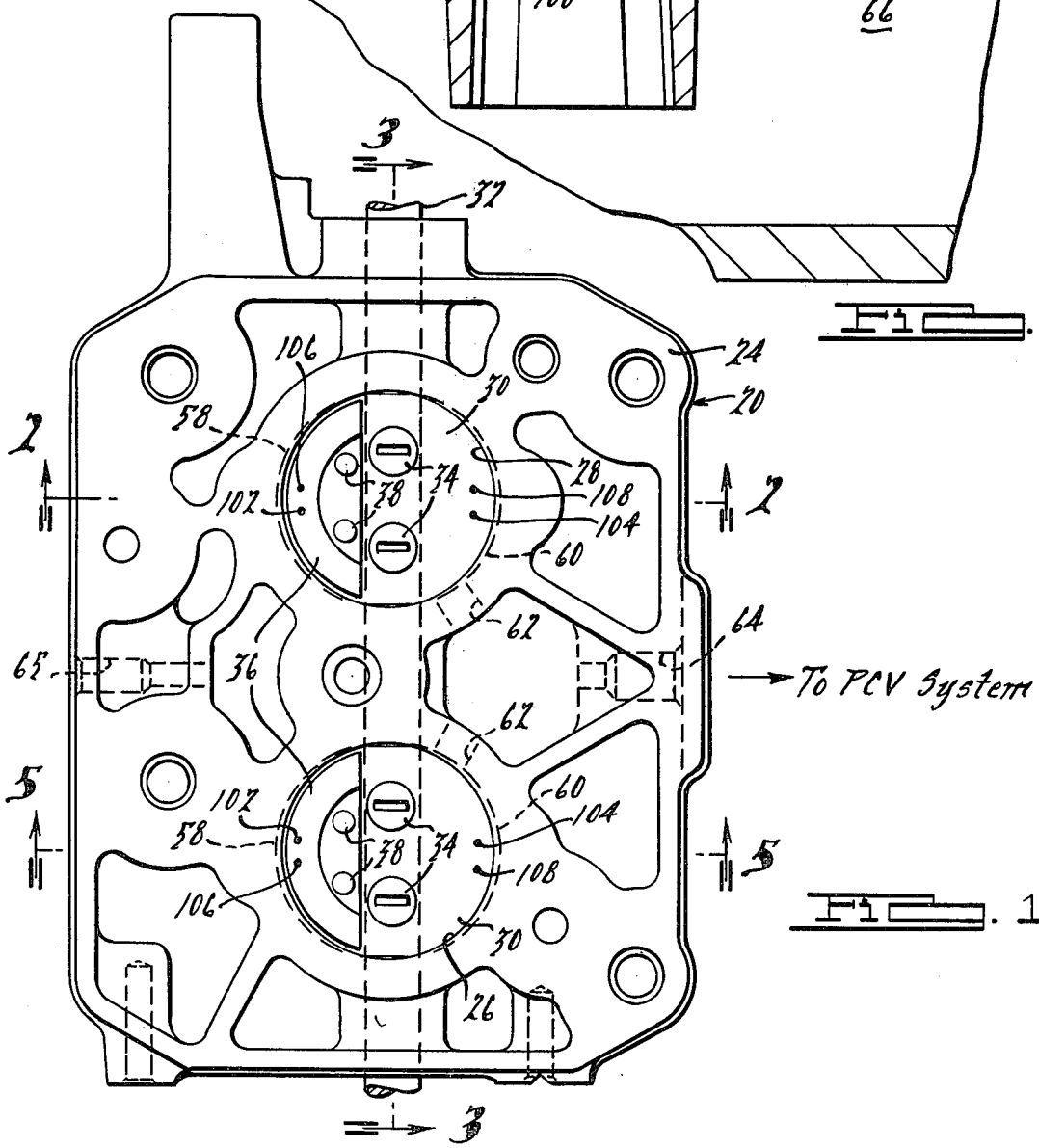
FIG. 1 is a top, plan view of a device embodying principles of the present invention.
Figure 4:
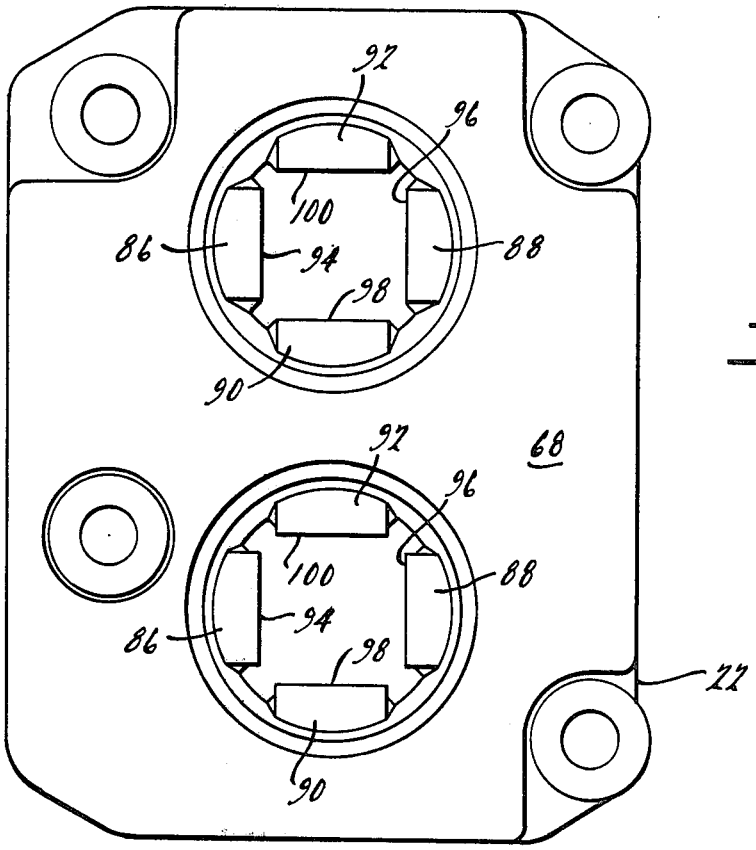
FIG. 4 is a horizontal sectional view taken in the direction of arrows 4—4 in FIG. 2.

In the preferred use of the present invention, a fuel spray system is located directly above each throttle blade. The spray system is not shown in the drawings and reference may be had to the above-mentioned U.S. Pat. No. 4,132,204 for details. Briefly, the spray system has, associated with each induction port, a main fuel rail and a separate power fuel rail. The main fuel rail is intended to spray fuel into the port at all times during operation while the power rail sprays fuel only when increased power is demanded. The main rail for each port comprises two orifices 102, 104 respectively which are located as shown in FIGS. 1 and 5. As can be seen, each orifice 102 is poised to spray a jet of fuel directly onto the deflection surface 50 of the corresponding upper deflector 36 as indicated by the arrow. Each orifice 104 sprays fuel onto the right hand portion of each throttle blade, also indicated by an arrow. Similarly, each power rail has a pair of orifices 106, 108 respectively, with each power orifice 106 poised to spray a jet of fuel into the left hand side of its induction port and each orifice 108 the right hand side of its port. From consideration of FIGS. 2 and 5, it will be appreciated that fuel sprayed from each main orifice 102 will be deflected by the corresponding upper deflector 36 when the throttle blades are within a certain range of open positions adjacent the closed position shown in these two figures. This serves to deflect fuel against the left-hand wall of each port. However, for throttle blade openings greater than this certain range, fuel sprayed from main orifices 102 will not impinge upon the deflectors but instead will be sprayed directly toward deflectors 78 in the respective diffusion, or dispersion, tubes 74, 76 of mixer 22. Likewise, main orifices 104 will spray directly toward deflectors 80 in the two tubes instead of onto the right hand portions of the blades. This will occur only under heavier engine loads where there is a higher volume air flow through the induction ports which to some extent will compensate for the upper deflectors 36 being out of the path of sprayed fuel from orifices 102. The power spray bars will typically become effectively only under heavier engine loads, and fuel sprayed from orifices 106, 108 respectively will be directed toward deflectors 78 and 80 also. It can be advantageous to make each left hand orifice of a slightly larger size than that of the corresponding right hand orifice so that each left hand orifice sprays at a higher flow rate than the corresponding right hand orifice. This helps toward achieving more uniform fuel distribution between the right hand and left hand halves of each induction port.

Figure 7:
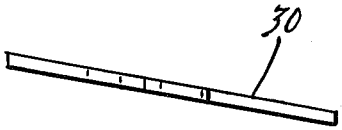
FIG. 7 is a view of the throttle blade of FIG. 6 shown in front elevation.
Figure 9:
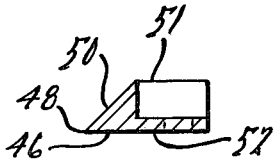
FIG. 9 is a sectional view taken in the direction of arrows 9—9 in FIG. 8.
Figure 10:
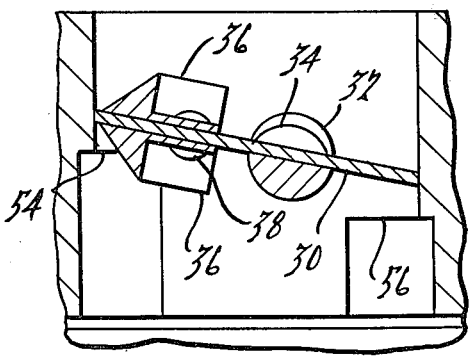
FIG. 10 is a fragmentary sectional elevational view on an enlarged scale illustrating one position.
Figure 11:
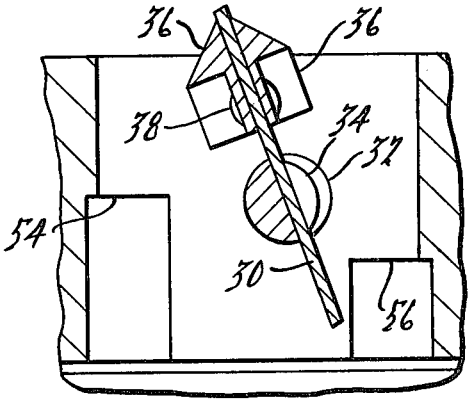
FIG. 11 is a view similar to FIG. 10 showing a different position.

FIG. 10 shows enlarged detail with the blades in the closed position, and FIG. 11 with the blades approaching the full open position. It can be seen in these two figures that the edge 48 is not precisely congruent with the peripheral edge of the throttle blade, and it is believed that exact congruency is not critical to the invention. This slight imprecision arises from expediencies in designing the blades and the deflectors for manufacture. Blades can best be made by striking with the blade blank inclined as in FIG. 7 and thus in a true plane view, the blades are not exactly circular. However, it is more convenient to make the edges 48 of the deflectors truly circular. When the deflectors are assembled to the blade, slight mix-match occurs along their respective edges, but, as mentioned, it is not believed critical. The blades may be punched from sheet material, aliminum, for example. The throttle body and mixer may be made from cast aluminum. The deflectors may be made from cast magnesium.

Although a specific type of system for introducing fuel into the device has been disclosed, it is contemplated that blade-mounted deflectors can be beneficial in other types of systems, such as for example, conventional carburetors. The benefit which can be derived is that the deflectors prevent excessive fuel wetting of the downstream faces of the throttle blades, which otherwise promotes a greater fuel concentration toward the right hand wall of the induction port and resultant inequality in fuel distribution.

With respect to mixer 22 it is believed that the disclosed arrangement of deflectors in each tube is particularly advantageous. By arranging the deflection surfaces in pairs wherein the two deflectors of each pair are diametrically opposite each other and each immediately successive downstream pair is circumferentially offset 90° relative to the immediately preceding upstream pair, it is believed that substantial interruption of the boundary layer along the wall of the mixing tubes is achieved, resulting in minimized wetting of the walls by liquid fuel. It is further believed that the principles of the mixing tube can be utilized to advantage anywhere in the induction system of the engine and do not necessarily have to be limited to the specifically disclosed preferred embodiment.

While a preferred embodiment has been disclosed, it will be appreciated that modifications and variations may be made within the scope of the following claims.

What is claimed is:

1. In an internal combustion engine having a throttle body comprising an induction port of circular cross section forming a segment of the induction passage, a throttle shaft extending centrally transversely across the induction port and mounted on the throttle body for rotation about its own axis, a throttle blade of generally circular shape disposed on the throttle shaft which selectively throttles the induction passage in accordance with rotation of the throttle shaft, and means for introducing fuel into the induction passage upstream of the throttle blade to form a combustible mixture with induction air, and a set of deflectors on the wall of the induction passage downstream of the throttle blade, an improved arrangement for the deflectors for imparting increased turbulence to the combustible mixture to improve atomization and distribution of the fuel comprising: each deflector comprising a deflection surface inclining from the induction passage wall radially inwardly in the downstream direction and terminating in a sharp edge which is generally transverse to the direction of flow through the induction passage, said deflectors being arranged in pairs, wherein the deflectors of each pair are diametrically opposite each other across the wall with a first pair of deflectors being disposed circumferentially in alignment with the longitudinal ends of the throttle shaft and with a second pair of deflectors being disposed upstream of the first pair and at an orientation which is circumferentially at 90° relative to the deflectors of the first pair, and wherein the entirety of both sharp edges of the second pair are disposed upstream of the entirety of both sharp edges of the first pair, further including a sharp shearing edge disposed on the induction port of the throttle body generally coextensive with a marginal circumferential segment of the throttle blade which swings upstream as the throttle blade is increasingly opened, said sharp shearing edge being disposed downstream of said throttle blade segment and upstream of the deflectors.

2. The arrangement set forth in claim 1 including a second sharp shearing edge on the induction port opposite the first-mentioned sharp shearing edge, said second sharp shearing edge being generally circumferentially co-extensive with a marginal circumferential segment of the throttle blade which swings downstream as the throttle blade is increasingly opened and being disposed downstream of said last-mentioned throttle blade segment with the throttle blade in the closed position and upstream of the deflectors.

3. The arrangement set forth in claim 1 including a deflector element disposed on the surface of the throttle blade which faces downstream when the blade is closed and extending circumferentially along said marginal segment of the throttle blade, said element comprising a deflection surface which in radial section with the blade in the closed position inclines radially inwardly in the downstream direction.

4. The arrangement as set forth in claim 3 including a second deflector element disposed on the opposite surface of the throttle blade directly over the first-mentioned element and comprising a deflection surface which with the blade in the closed position inclines radially inwardly in the upstream direction.

* * * * *